US007712547B2

(12) United States Patent
Ikuta et al.

(10) Patent No.: US 7,712,547 B2
(45) Date of Patent: May 11, 2010

(54) ELECTRIC HAMMER

(75) Inventors: Hiroki Ikuta, Anjo (JP); Yonosuke Aoki, Anjo (JP)

(73) Assignee: Makita Corporation, Anjo-Shi (JP)

( * ) Notice: Subject to any disclaimer, the term of this patent is extended or adjusted under 35 U.S.C. 154(b) by 0 days.

(21) Appl. No.: 11/918,067

(22) PCT Filed: Apr. 10, 2006

(86) PCT No.: PCT/JP2006/307569

§ 371 (c)(1),
(2), (4) Date: Oct. 9, 2007

(87) PCT Pub. No.: WO2006/109772

PCT Pub. Date: Oct. 19, 2006

(65) Prior Publication Data

US 2009/0032275 A1 Feb. 5, 2009

(30) Foreign Application Priority Data

Apr. 11, 2005 (JP) ..... 2005-114025
Apr. 11, 2005 (JP) ..... 2005-114026

(51) Int. Cl.
*B25D 17/00* (2006.01)
*B25D 17/24* (2006.01)

(52) U.S. Cl. ..... 173/162.1; 173/162.2; 173/48

(58) Field of Classification Search ..... 173/162.1, 173/162.2; 408/143; 188/380
See application file for complete search history.

(56) References Cited

U.S. PATENT DOCUMENTS 4,478,293 A 10/1984 Weilenmann et al.
6,315,277 B1 * 11/2001 Nagasawa ..... 267/140.14
2003/0006051 A1 * 1/2003 Schmitzer et al. ..... 173/49
2006/0076154 A1 * 4/2006 Aoki ..... 173/212

FOREIGN PATENT DOCUMENTS

| | | | |
|---|---|---|---|
| EP | 1 437 200 | A1 | 7/2004 |
| EP | 1 439 038 | A1 | 7/2004 |
| EP | 1 464 449 | A2 | 10/2004 |
| JP | A 57-211482 | | 12/1982 |
| JP | A 2004-216484 | | 12/1982 |
| JP | A 61-178188 | | 8/1986 |
| JP | A 01-274973 | | 11/1989 |
| JP | A 01-316179 | | 12/1989 |
| JP | A 2004-276185 | | 10/2004 |
| JP | A 2004-299036 | | 10/2004 |
| WO | WO 2004/082897 | A1 | 9/2004 |

* cited by examiner

*Primary Examiner*—Rinaldi I. Rada
*Assistant Examiner*—Nathaniel Chukwurah
(74) *Attorney, Agent, or Firm*—Oliff & Berridge, PLC

(57) ABSTRACT

An electric hammer comprising a hammer bit (313) performing hammering work on a work, a drive motor, a hammering piece (334) driven by the drive motor to apply a hammering force to the hammer bit, and a mechanism (371) for damping vibration generated during hammering. The damping performance of the electric hammer is enhanced by causing the driving amount applied to the damping mechanism (371) to vary between a first mode where the damping mechanism (371) generates vibration of the hammer bit (313) subjected to an external force from the work during the load driving time and thereby optimizes the damping and a second mode where the damping mechanism (371) generates vibration corresponding to the vibration of the hammer bit (313) not subjected to an external force from the work during the no-land driving time and optimizes damping.

14 Claims, 11 Drawing Sheets

ELECTRIC HAMMER

FIELD OF THE INVENTION

The present invention relates to a technique for reducing vibration of an electric hammer that performs a hammering operation on a workpiece.

BACKGROUND OF THE INVENTION

Japanese laid-open patent publication No. 2004-299036 discloses an electric hammer having a dynamic vibration reducer which forms a vibration reducing mechanism. In this hammer, a weight of the dynamic vibration reducer is actively driven by utilizing the pressure within the crank chamber, so that vibration caused during hammering operation can be reduced.

Further, Japanese laid-open patent publication No. 2004-216484 discloses an electric hammer having a counter weight which forms a vibration reducing mechanism. In this hammer, the counter weight is driven via a crank mechanism that converts the rotating output of the electric motor into linear motion, and it serves to reduce vibration caused in the hammer during hammering operation. However, further device improvement is desired in both of these known vibration reducing techniques.

DISCLOSURE OF THE INVENTION

Problems to be Solved by the Invention

Accordingly, it is an object of the present invention to provide a technique that contributes to further improvement of the vibration reducing function in an electric hammer.

Means for Solving the Problems

In order to solve the above-described problem, the present invention provides an electric hammer including an electric hammer body, a hammer bit that is coupled to the body and performs a hammering operation in contact with a workpiece, a driving motor that is housed within the body, a striker that is housed within the body and driven by the driving motor to apply a striking force to the hammer bit, and a vibration reducing mechanism that is linearly driven in an axial direction of the hammer bit and generates vibration, thereby reducing vibration caused in the body.

In the electric hammer according to the invention, first mode and second mode are provided. In a first mode, under loaded driving conditions in which a load acts on the hammer bit from the workpiece side by the hammering operation, the vibration reducing mechanism optimizes vibration reduction by generating vibration corresponding to vibration caused in the body. In a second mode, under unloaded driving conditions in which the driving motor is energized and the hammering operation is not performed, while no load acts on the hammer bit from the workpiece side, the vibration reducing mechanism optimizes vibration reduction by generating vibration corresponding to vibration caused in the body. Preferably, by changing at least one or more of the amplitude, frequency and phase of the vibration reducing mechanism, the vibration reducing mechanism may generate optimum vibration for canceling out the vibration caused in the electric hammer and thereby optimizes the vibration reduction of the electric hammer.

According to the invention, the amount of drive of the vibration reducing mechanism differs according to whether under the loaded driving conditions in which vibration reduction is highly required or under the unloaded driving condition in which vibration reduction is less required. Specifically, the amount of drive to be provided to the vibration reducing mechanism is changed such that, under the loaded driving conditions, the vibration reducing mechanism generates vibration corresponding to vibration caused under the loaded driving conditions, while, under the unloaded driving conditions, the vibration reducing mechanism generates vibration corresponding to vibration caused under the unloaded driving conditions. In this manner, suitable vibration reducing effects can be obtained under each of the loaded and unloaded driving conditions. For example, when a dynamic vibration reducer is used as the vibration reducing mechanism, it is preferable that the frequency of the dynamic vibration reducer is set to be in the region of the maximum stroke of the striker which strikes the hammer bit. In this case, the frequency of the weight of the dynamic vibration reducer may preferably be generally equal to this natural frequency.

During hammering operation, the load conditions of the hammer bit based on an external force acting on the hammer bit from the workpiece side may preferably be detected by the magnitude of the load current of the driving motor, and the vibration reducing mechanism may be controlled according to the detected load conditions. As a result, the structure can be simplified compared with the known method of detecting the load conditions of the hammer bit by using a mechanical detecting mechanism.

REPRESENTATIVE EMBODIMENTS OF THE INVENTION

First Representative Embodiment of the Invention

Figure 1:
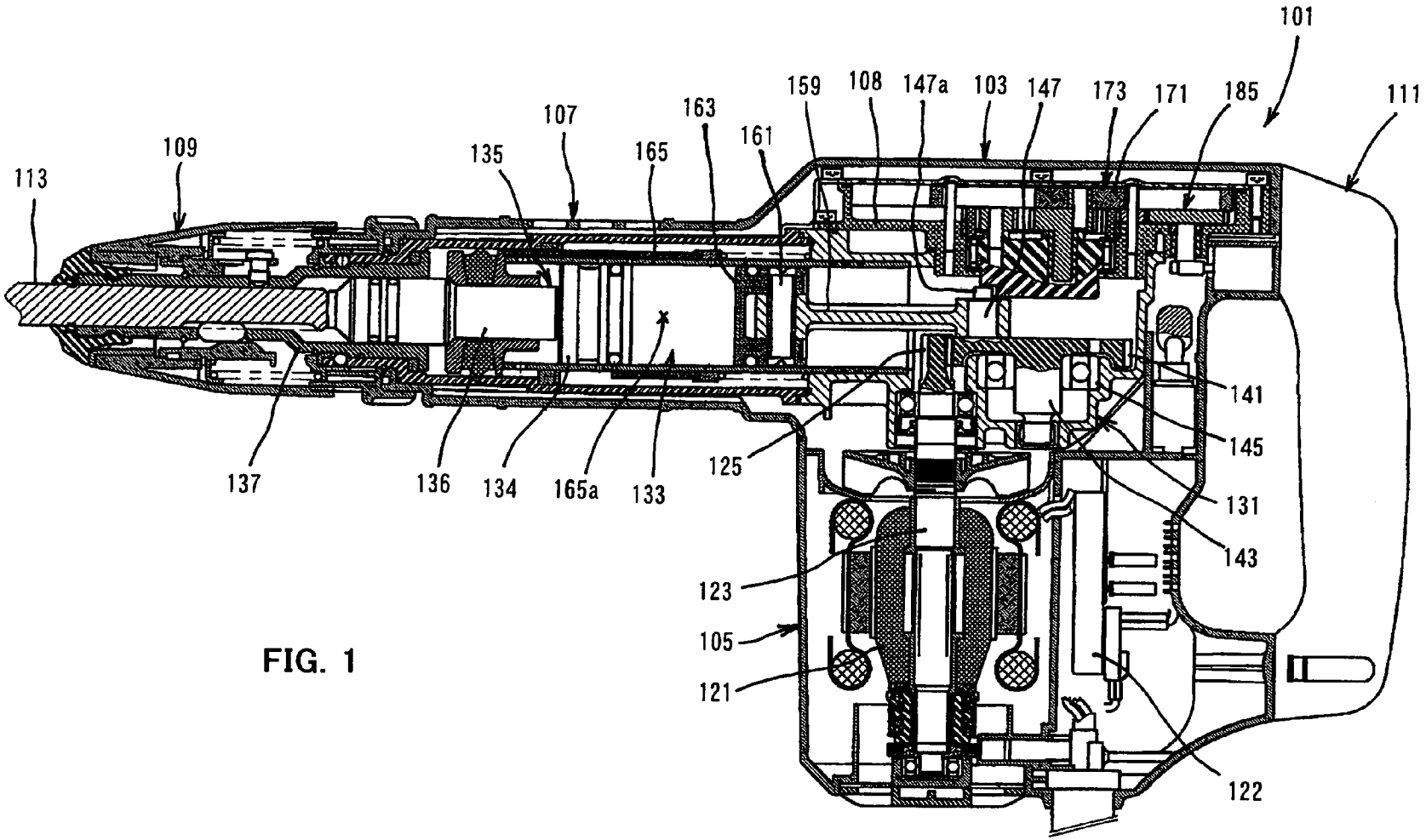
FIG. 1 is a sectional side view schematically showing an entire electric hammer according to a first embodiment of the invention.

An electric hammer (hereinafter referred to as hammer) according to a first representative embodiment of the present invention will now be described with reference to the drawings. FIG. 1 shows an entire hammer 101 according to this embodiment. The hammer 101 according to this embodiment includes a hammer body 103 having a motor housing 105, a gear housing 107 and a handgrip 111. A hammer bit 113 is coupled to the tip end (the left end region as viewed in FIG. 1) of the hammer body 103 via a hammer bit mounting chuck 109.

The motor housing 105 houses a driving motor 121. The gear housing 107 houses a crank mechanism 131, an air cylinder mechanism 133 and a striking force transmitting mechanism 135. A tool holder 137 for holding the hammer bit 113 is disposed on the end (left end as viewed in FIG. 1) of the striking force transmitting mechanism 135 within the gear housing 107. The crank mechanism 131 in the gear housing 107 converts the rotating output of an output shaft 123 of the driving motor 121 into linear motion and transmits the motion to the hammer bit 113. As a result, the hammer bit 113 is caused to perform a hammering operation. The tool holder 137 holds the hammer bit 113 in such a manner that the hammer bit 113 can reciprocate with respect to the tool holder 137 in its longitudinal direction and is prevented from rotating in its circumferential direction with respect to the tool holder 137.

The crank mechanism 131 is disposed right below a housing cap 108 within the gear housing 107 and includes a speed change gear 141, a gear shaft 143, a gear shaft support bearing 145 and a crank pin 147. The speed change gear 141 engages with a gear part 125 of the output shaft 123 of the driving motor 121. The gear shaft 143 rotates together with the speed change gear 141. The gear shaft support bearing 145 rotatably supports the gear shaft 143. The crank pin 147 is integrally formed with the speed change gear 141 in a position displaced a predetermined distance from the center of rotation of the gear shaft 143. The crank pin 147 is connected to one end of a crank arm 159. The other end of the crank arm 159 is connected to a driver in the form a piston 163 via a connecting pin 161. The piston 163 is disposed within a bore of a cylinder 165 that forms the air cylinder mechanism 133. The piston 163 slides within the cylinder 165 so as to linearly drive the striker 134 by the action of an air spring of an air spring chamber 165*a*. As a result, the piston 163 generates impact loads upon the hammer bit 113 via an intermediate element in the form of an impact bolt 136. The striker 134 and the impact bolt 136 form the striking force transmitting mechanism 135. The striker 134 is a feature that corresponds to the "striker" in the present invention.

Figure 2:
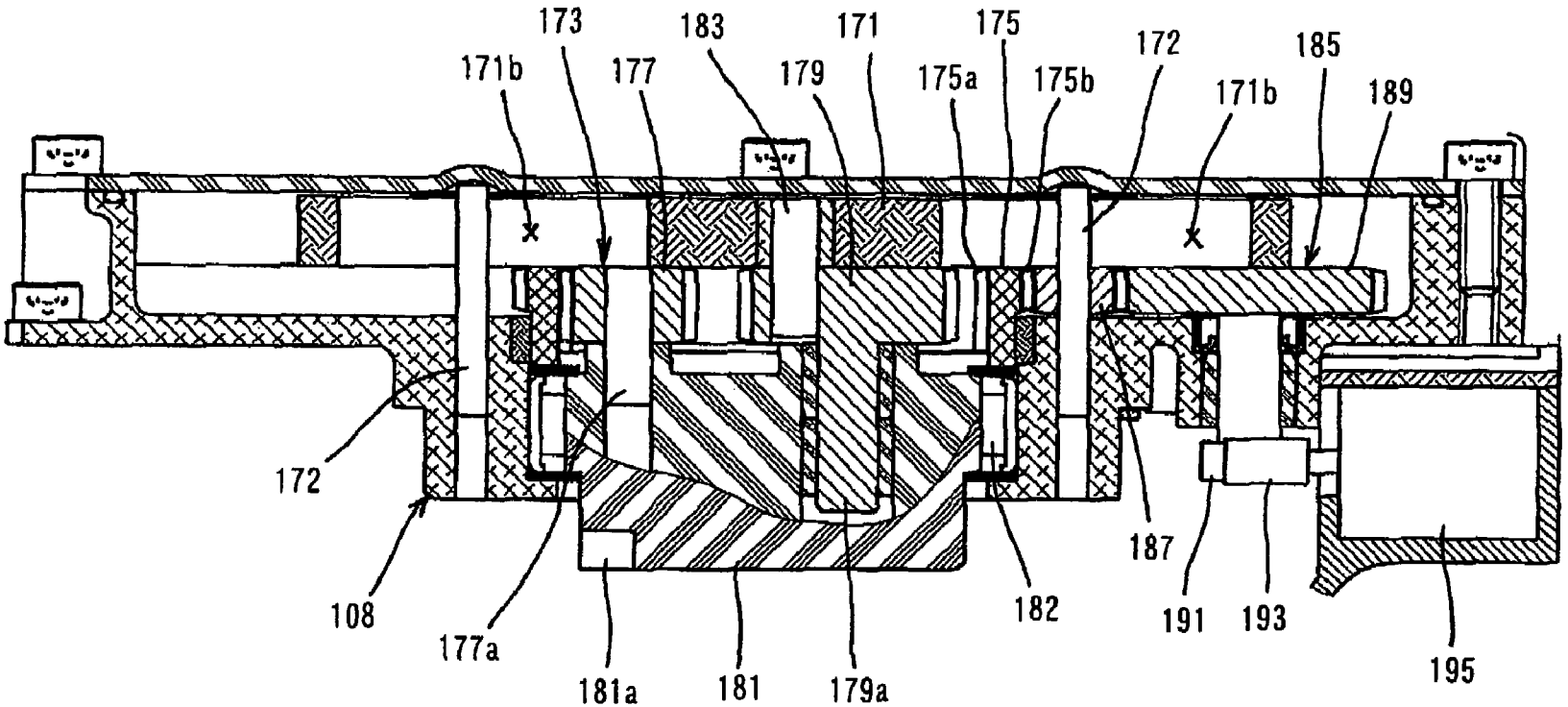
FIG. 2 is a sectional partial view showing a counter weight driving mechanism and a stroke changing mechanism.
Figure 3:
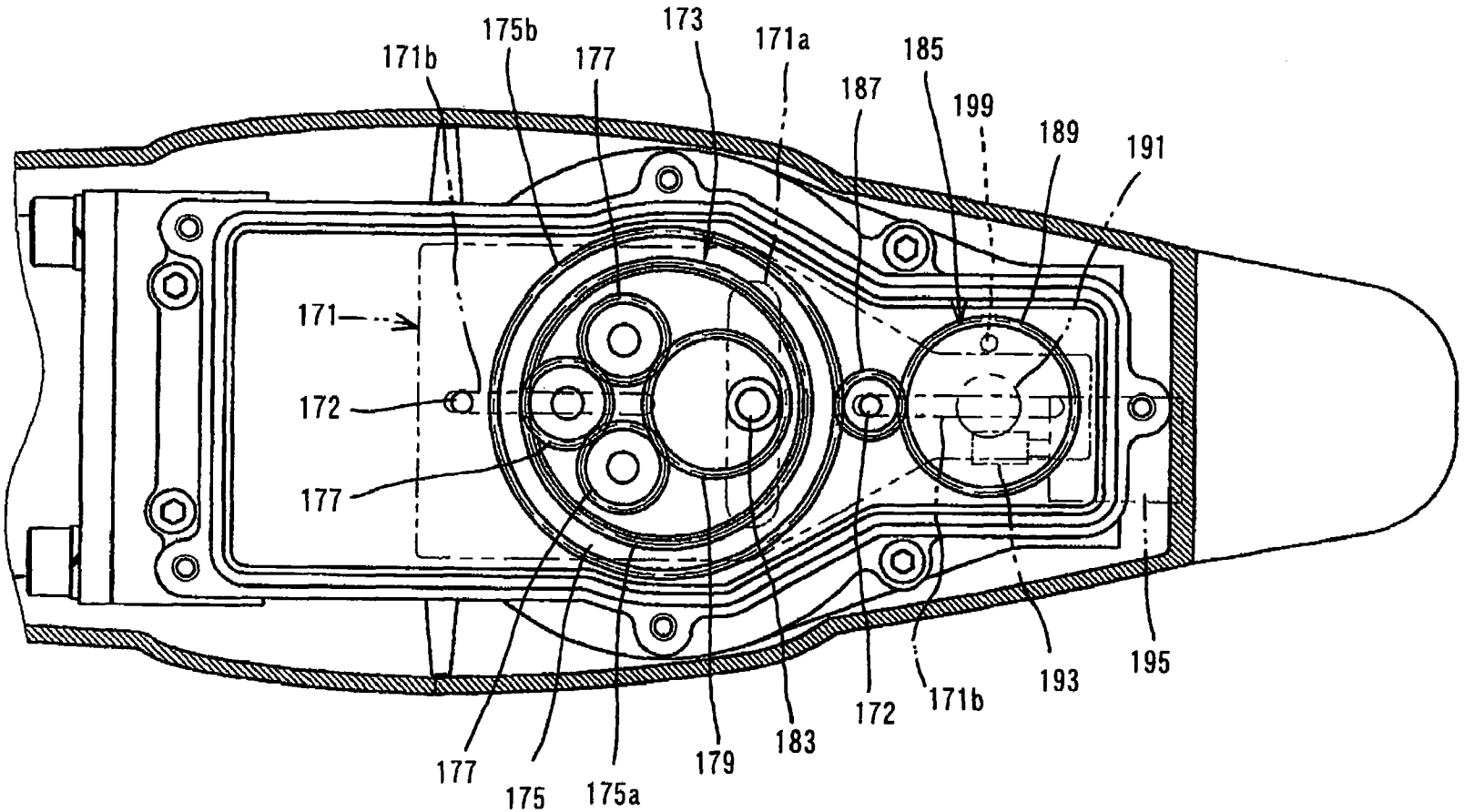
FIG. 3 is a plan view showing the counter weight driving mechanism and the stroke changing mechanism, in the state of the maximum stroke of the counter weight.
Figure 4:
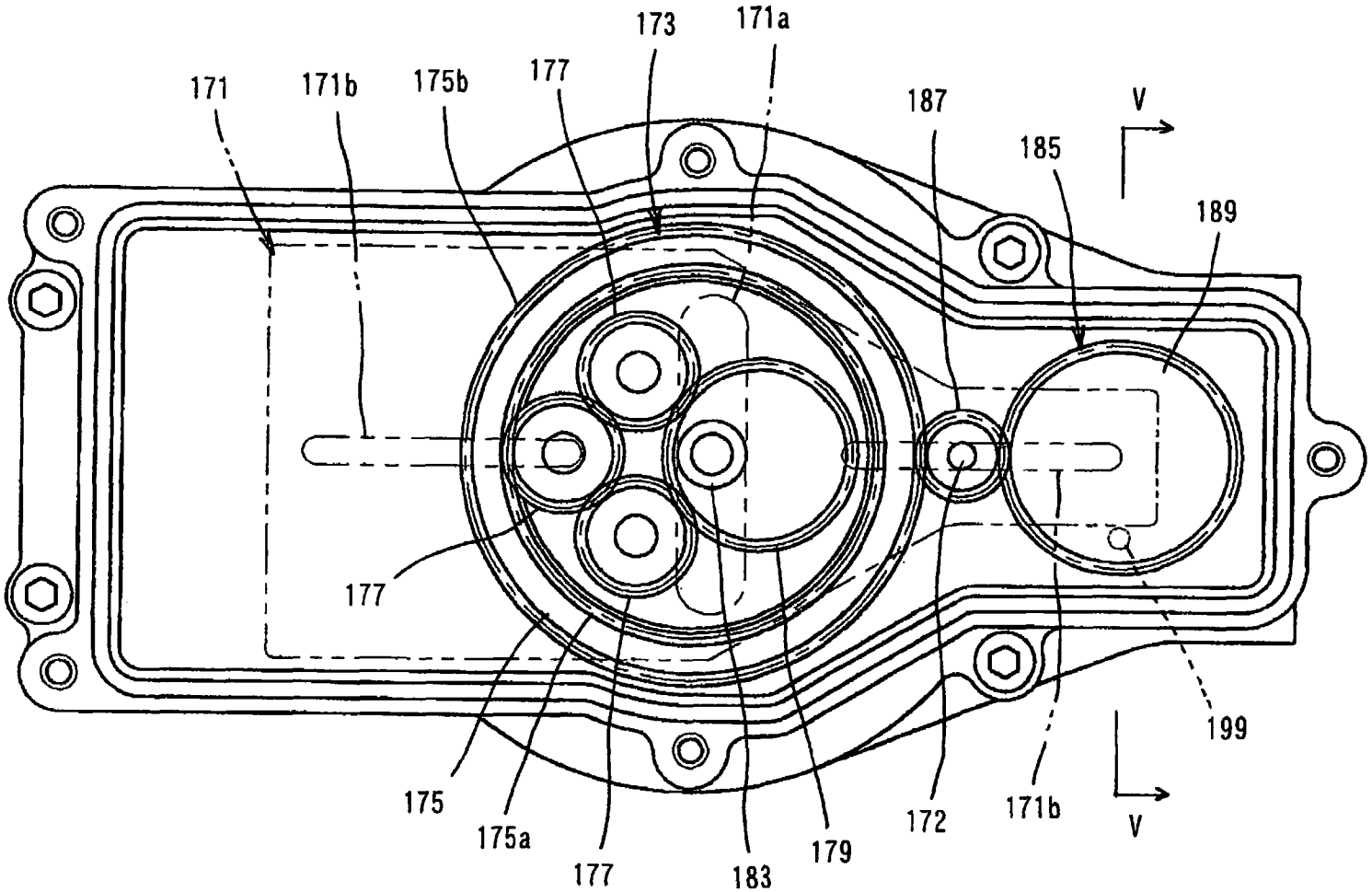
FIG. 4 is a plan view showing the counter weight driving mechanism and the stroke changing mechanism, in the state of the minimum stroke of the counter weight.

FIGS. 2 to 4 show a counter weight driving mechanism 173 and a stroke changing mechanism 185. The counter weight driving mechanism 173 drives a counter weight 171 that serves to reduce vibration when the hammer bit 113 is driven. The stroke changing mechanism 185 serves to change the linear stroke of the counter weight 171. FIG. 2 is a sectional partial view, and FIGS. 3 and 4 are plan views. The counter weight 171 is a feature that corresponds to the "vibration reducing mechanism" in this invention, and the counter weight driving mechanism 173 and the stroke changing mechanism 185 are features that correspond to the "power transmitting mechanism" in this invention. The counter weight 171 is disposed above the housing cap 108 and can be moved linearly in the axial direction of the hammer bit 113. The counter weight 171 has a guide slot 171*b* extending in the axial direction of the hammer bit 113. A plurality of (two in this embodiment) guide pins 172 extend through the guide slot 171*b* and guide the counter weight 171 to move linearly in the axial direction of the hammer bit 113. The guide pins 172 are fixedly mounted to the housing cap 108.

The counter weight driving mechanism 173 is disposed between the crank mechanism 131 and the counter weight 171 and serves to cause the counter weight 171 to reciprocate in a direction opposite to the reciprocating direction of the striker 134. The counter weight driving mechanism 173 includes an internal gear 175, a planetary gear 179, a carrier 181 and a counter weight driving pin 183. The planetary gear 179 engages with internal teeth 175*a* of the internal gear 175 via a plurality of (three in this embodiment) idle gears 177. The carrier 181 rotatably supports the planetary gear 179 and the idle gears 177. The counter weight driving pin 183 is integrally formed with the planetary gear 179 in a position displaced a predetermined distance from the center of rotation of the planetary gear 179 with respect to the carrier 181. The counter weight driving pin 183 is a feature that corresponds to the "power transmitting part" in this invention.

The carrier 181 is rotatably supported by the housing cap 108 via a carrier support bearing 182. An engagement recess 181*a* is formed in the underside of the carrier 181 and engages with a top pin part 147*a* of the crank pin 147 of the crank mechanism 131 (see FIG. 1). Thus, when the crank pin 147 rotates, the carrier 181 is caused to rotate around an axis parallel to the axis of rotation of the speed change gear 141. The planetary gear 179 has a shaft 179*a* that is rotatably supported by the carrier 181. Each of the idle gears 177 has a shaft 177*a* that is press-fitted into the carrier 181, and the idle gear 177 is rotatably supported by the shaft 177*a*. The internal gear 175 is rotatably supported by the housing cap 108 and is normally prevented from rotating by the stroke changing mechanism 185.

The counter weight driving pin 183 is slidably fitted in a slot 171*a* that is formed in the counter weight 171 and extends linearly in a direction perpendicular to the axial direction of the hammer bit 113. When the carrier 181 is rotated by the crank pin 147 in the state in which the rotation of the internal gear 175 is prevented, the planetary gear 179 that engages with the internal gear 175 via the idle gears 177 revolves around the center of rotation of the internal gear 175 while rotating around the shaft 179*a*. At this time, the counter weight 117 is caused to reciprocate by components of motion of the counter weight driving pin 183 in the axial direction of the hammer bit 113. Thus, the counter weight 171 reciprocates in a direction generally opposite to the reciprocating direction of the striker 134 that is driven by the crank mechanism 131 via the air cylinder mechanism 133.

Figure 5:
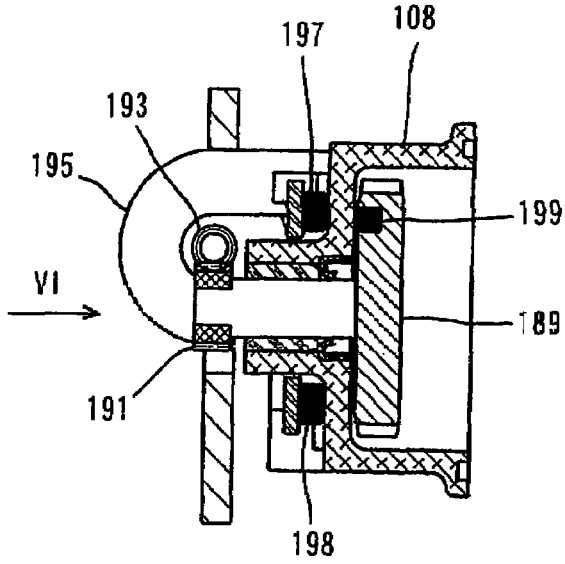
FIG. 5 is a sectional view taken along line V-V in FIG. 4.
Figure 6:
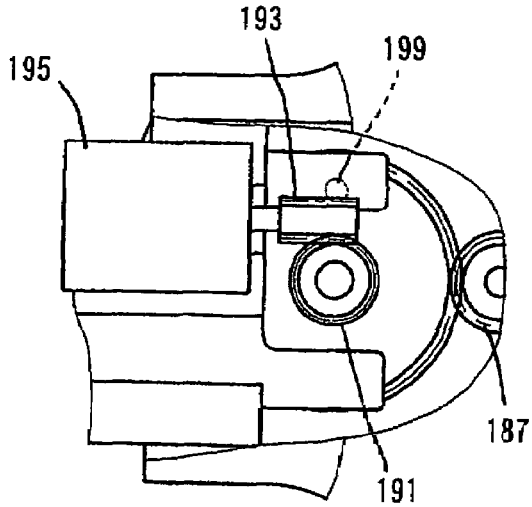
FIG. 6 is a view taken from the direction of arrow VI.

The stroke changing mechanism 185 for the counter weight 171 will now be explained with reference to FIGS. 2 to 6. FIG. 5 is a sectional view taken along line V-V in FIG. 4. FIG. 6 is a view taken from the direction of arrow VI. The stroke changing mechanism 185 can change the rotation prevented position of the internal gear 175 so that the stroke of the counter weight driving pin 183 in the axial direction of the hammer bit 113 and thus the linear stroke of the counter weight 171 in the axial direction of the hammer bit 113 can be changed. Thus, the stroke changing mechanism 185 forms a stroke control mechanism of the counter weight 171. The internal gear 175 has external teeth 175*b* on its outer peripheral surface. In the following description, the internal gear 175 is referred to as externally-toothed internal gear 175.

The stroke changing mechanism 185 includes a stroke changing gear 189 that engages with the external teeth 175*b* of the externally-toothed internal gear 175 via an intermediate gear 187 at all times, a worm wheel 191 that rotates together with the stroke changing gear 189, a worm gear 193 that engages with the worm wheel 191 at all times, and an auxiliary motor 195 that drives the worm gear 193. Specifically, the stroke changing mechanism 185 is powered from the auxiliary motor 195 and rotates the externally-toothed internal gear 175. As shown in FIG. 5, a magnet 199 is installed in the stroke changing gear 189. A first sensor 197 and a second sensor 198 for detecting the magnet 199 are disposed on the housing cap 108 and arranged with a phase difference of 180° around the center of rotation of the stroke changing gear 189. The first sensor 197 and the second sensor 198 are provided to detect a rotation prevented position of the externally-toothed internal gear 175 and output respective positioning signals for positioning the counter weight driving pin 183 in predetermined respective positions. Specifically, when the first sensor 197 detects the magnet 199, the first sensor 197 outputs a signal for positioning the counter weight driving pin 183 in a position (shown in FIG. 3) for loaded driving. When the second sensor 198 detects the magnet 199, the second sensor 198 outputs a signal for positioning the counter weight driving pin 183 in a position (shown in FIG. 4) for unloaded driving. The auxiliary motor is then stopped according to this signal. Thus, the stroke changing gear 189 is locked for every 180° rotation. The first and the second sensors 197, 198 and the magnet 199 are features that correspond to the "positioning means" according to this invention.

The load current of the driving motor 121 that drives the hammer bit 113 increases under loaded driving conditions in which the hammer bit 113 is subjected to a load caused by a hammering operation (external force or reaction force that is inputted from the workpiece side to the hammer bit 113 during hammering operation), while it decreases under unloaded driving conditions in which the hammer bit 113 is not subjected to a load caused by a hammering operation. In consideration of this phenomenon, in this embodiment, a motor controller 122 (motor control circuit, see FIG. 1) for controlling the drive of the driving motor 121 detects the driving conditions, loaded or unloaded, by change (increase or decrease) of the load current of the driving motor 121. Based on this detection result, a driving signal is outputted to the auxiliary motor 195. Specifically, in the driving state of the hammer 101, when the load current of the driving motor 121 exceeds a threshold value, it is determined that it has been shifted from the unloaded driving conditions to the loaded driving conditions. On the other hand, when the load current of the driving motor 121 decreases below the threshold value, it is determined that it has been shifted from the loaded driving conditions to the unloaded driving conditions. In the both cases, respective driving signals are outputted to the auxiliary motor 195.

The once started auxiliary motor 195 is stopped according to the detection signal which the first sensor 197 or the second sensor 198 outputs when it detects the magnet 199. As a result, after started, the stroke changing gear 189 is rotated 180° and then stopped and locked in that position. The motor controller 122 (motor control circuit) for controlling the drive of the driving motor 121 detects change of the load current of the driving motor 121. Based on this detection result, a driving signal is outputted to the auxiliary motor 195. Further, the worm gear 193 is designed to have a small lead angle such that the worm gear 193 is provided with a reverse rotation preventing function of preventing it from being caused to rotate from the worm wheel 191 side. Thus, the internal gear 175 is held in the rotation prevented state when the auxiliary motor 195 is in the stopped state. The rotation prevented state corresponds to the "rest state" according to this invention.

The hammer 101 according to this embodiment is constructed as described above. Specifically, in the hammer 101, the stroke of the counter weight driving pin 183 in the axial direction of the hammer bit can be changed by changing the rotation prevented position of the externally-toothed internal gear 175. With this construction, the linear stroke of the counter weight 171, which is driven by the counter weight driving pin 183, in the axial direction of the hammer bit 113 can be changed. The principle will now be explained.

Figure 7:
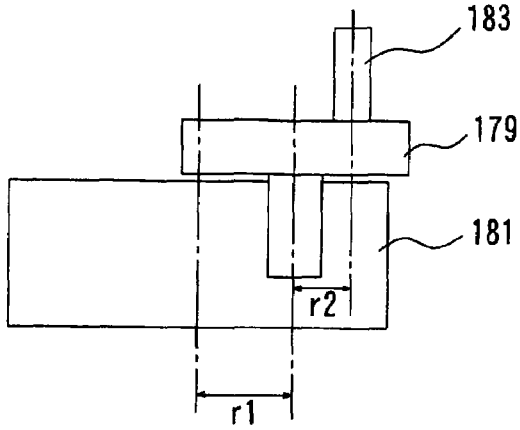
FIG. 7 is a schematic view illustrating the setting conditions of the counter weight driving mechanism.

In this embodiment, the number of the teeth of the planetary gear 179 is chosen to be half of the number of the internal teeth 175*a* of the externally-toothed internal gear 175. In other words, the planetary gear 179 turns two turns on its center while revolving one turn around the center of the externally-toothed internal gear 175. Further, the number of the teeth of the stroke changing gear 189 is chosen to be half of the number of the external teeth 175*b* of the internal gear 175. As schematically shown in FIG. 7, the distance between the axis of rotation of the carrier 181 and the axis of rotation of the planetary gear 179 is designated by r1, and the distance between the axis of rotation of the planetary gear 179 and the axis of rotation of the counter weight driving pin 183 is designated by r2.

Figure 8:
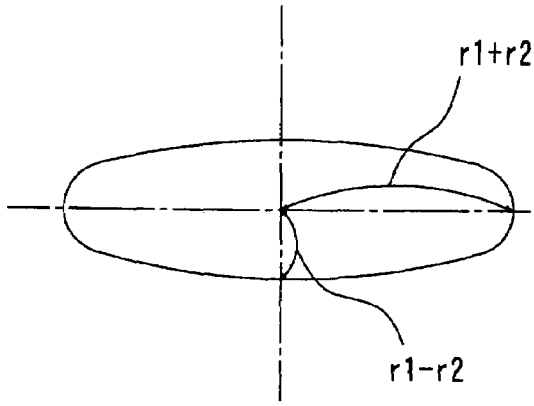
FIG. 8 is a schematic view illustrating a path of movement of a counter weight driving pin when a stroke changing gear is locked in a certain position and a carrier is rotated.

When the stroke changing gear 189 (and thus the externally-toothed internal gear 175) is locked in a certain position and the carrier 181 is rotated, as schematically shown in FIG. 8, the counter weight driving pin 183 moves along an elliptic path having a major axis of (r1+r2) and a minor axis of (r1−r2). When (r1−r2)=0, the stroke of the counter weight driving pin 183 in the direction of the minor axis is zero. When the above locked position of the stroke changing gear 189 is rotated 180°, the counter weight driving pin 183 moves along an elliptic path shown in FIG. 9, which path is obtained by rotating the path in FIG. 8 by 90°. Specifically, when the stroke changing gear 189 is locked for every 180° rotation, the path of the counter weight driving pin 183 can be switched between the states shown in FIGS. 8 and 9. Therefore, if the counter weight 171 is mounted onto the counter weight driving pin 183, the linear stroke of the counter weight 171 in the axial direction of the hammer bit can be switched between the longer stroke of {2×(r1+r2)} and the shorter stroke of {2×(r1−r2)}.

In this embodiment, as shown in FIG. 3, when the planetary gear 179 is located in the rear end region (or the front end region) of the internal gear 175 in the axial direction of the hammer bit, the counter weight driving pin 183 is located in the nearest position to the point of proximity of the planetary gear 179 to the internal gear 175. Further, as shown in FIG. 4, when the planetary gear 179 is located in the rear end region (or the front end region) of the internal gear 175 in the axial direction of the hammer bit 113, the counter weight driving pin 183 is located in the remotest position from the point of proximity of the planetary gear 179 to the internal gear 175. In the state shown in FIG. 3, the first sensor 197 detects the magnet 199 and locks the stroke changing gear 189. In the state shown in FIG. 4, the second sensor 198 detects the magnet 199 and locks the stroke changing gear 189. Specifically, rotation of the stroke changing gear 189 is prevented with a phase difference of 180° according to the detection of the magnet 199 by the first sensor 197 and the second sensor 198. Thus, the internal gear 175 which has the external teeth 175*b* twice as many as the teeth of the stroke changing gear 189 is prevented from rotating with the phase difference of 90° between its rotation prevented positions.

Operation and usage of the hammer 101 will now be explained. When the driving motor 121 is driven, the piston 163 is caused to reciprocate within the bore of the cylinder 165 via the output shaft 123, the speed change gear 141, the crank pin 147, the crank arm 159 and the connecting pin 161. At this time, under the loaded driving conditions in which the hammer bit 113 is pressed against the workpiece, the hammer bit 113 is driven linearly in its axial direction via the air cylinder mechanism 131 and the striking force transmitting mechanism 135. Specifically, when the piston 163 slides toward the hammer bit 113, which causes an air spring action of the air spring chamber 165*a* that is defined between the piston 163 and the striker 134, the striker 134 is caused to reciprocate in the same direction within the cylinder 165 by the air spring action and collides with the impact bolt 136. The kinetic energy (striking force) of the striker 134 which is caused by the collision is transmitted to the hammer bit 113. Thus, the hammer bit 113 slidingly reciprocates within the tool holder 137 and performs a hammering operation on the workpiece. Large vibration is caused in the hammer 101 in the axial direction of the hammer bit 113 during the loaded driving conditions. Therefore, reduction of such vibration is highly desired.

Under unloaded driving conditions in which the hammer bit 113 is not pressed against the workpiece, an idle hammering preventing mechanism is actuated. Specifically, the air spring chamber 165*a* communicates with the outside via a vent hole, so that air within the air spring chamber 165*a* is not compressed. The idle hammering preventing mechanism is known and will not be specifically described below. Thus, the striker 134 is not driven. Therefore, vibration is caused in the hammer 101 in the axial direction of the hammer bit 113 mainly by reciprocating movement of the piston 163. Such vibration is smaller than under the loaded driving conditions and less desired to be reduced.

When the driving motor 121 is shifted, for example, from the unloaded driving conditions to the loaded driving conditions, the load on the driving motor 121 increases, and thus the load current of the driving motor 121 increases. When the load current exceeds a threshold value, a driving signal is outputted to the auxiliary motor 195, and the auxiliary motor 195 is driven. Then the stroke changing gear 189 is rotated via the worm gear 193 and the worm wheel 191. When the stroke changing gear 189 is rotated 180° and the first sensor 197 detects the magnet 199, the auxiliary motor 195 is stopped according to the detection signal. By the 180° rotation of the stroke changing gear 189, the externally-toothed internal gear 175 is rotated 90° via an intermediate gear 187. Then the planetary gear 179 is shifted from the state shown in FIG. 4 to the state shown in FIG. 3. When the planetary gear 179 is located in the rear end region (or the front end region) of the externally-toothed internal gear 175 in the axial direction of the hammer bit 113, the counter weight driving pin 183 is located in the nearest position to the point of proximity of the planetary gear 179 to the internal gear 175. In this state, when the counter weight driving pin 183 revolves while rotating, the counter weight driving pin 183 has a longer stroke in the axial direction of the hammer bit as schematically shown in FIG. 8. By utilizing the stroke of the counter weight driving pin 183, the counter weight 171 is driven in the axial direction of the hammer bit 113 and in a direction opposite to the reciprocating direction of the striker 134. In this manner, the counter weight 171 can efficiently reduce vibration during hammering operation of the hammer bit 113.

Figure 9:
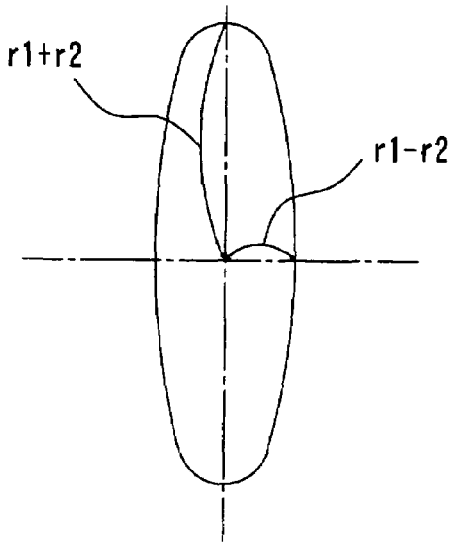
FIG. 9 is a schematic view illustrating a path of movement of the counter weight driving pin when the stroke changing gear is locked in a certain position and the carrier is rotated.

On the other hand, when the driving motor 121 is shifted from the loaded driving conditions to the unloaded driving conditions, the load on the driving motor 121 decreases, and thus the load current of the driving motor 121 decreases below the threshold value. As a result, a driving signal is outputted to the auxiliary motor 195, and the auxiliary motor 195 is driven. Then the stroke changing gear 189 is rotated 180° and the second sensor 197 detects the magnet 199. At this time, the auxiliary motor 195 is stopped according to the detection signal. By the 180° rotation of the stroke changing gear 189, the externally-toothed internal gear 175 is rotated 90° via the intermediate gear 187. Then the planetary gear 179 is shifted from the state shown in FIG. 3 to the state shown in FIG. 4. When the planetary gear 179 is located in the rear end region (or the front end region) of the internal gear 175 in the axial direction of the hammer bit 113, the counter weight driving pin 183 is located in the remotest position from the point of proximity of the planetary gear 179 to the internal gear 175. In this state, when the counter weight driving pin 183 revolves while rotating, the counter weight driving pin 183 has a shorter stroke in the axial direction of the hammer bit as schematically shown in FIG. 9. In this case, when r1−r2=0 in FIG. 9, the apparent stroke of the counter weight driving pin 183, which is located in the remotest position from the point of proximity of the planetary gear 179 to the internal gear 175, is zero in the axial direction of the hammer bit even though the planetary gear 179 revolves.

As a result, under unloaded driving conditions, even if the planetary gear 179 revolves around the center of rotation of the externally-toothed internal gear 175, the counter weight driving pin 183 does not move in the axial direction of the hammer bit. In other words, under unloaded driving conditions in which vibration reduction is less desired, even though the driving motor 121 is driven and the planetary gear 179 revolves around the center of rotation of the internal gear 175, the counter weight driving pin 183 does not drive the counter weight 171 in the longitudinal direction of the hammer 101. Therefore, undesired vibration can be prevented from being caused when the counter weight 171 is driven. The linear stroke of the counter weight 171 was described above as zero, but the counter weight 171 may be driven with a linear stroke corresponding to the magnitude of the vibration caused when the piston 163 is driven.

As described above, according to this embodiment, the load current of the driving motor 121 is electrically detected under the loaded and unloaded driving conditions, and the linear stroke of the counter weight 171 is controlled based on the detection. Therefore, compared with the known method of detecting loaded and unloaded driving conditions by using a mechanical detecting mechanism and changing the linear stroke of the counter weight 171 based on the detection, the vibration reducing control system can be simplified.

As described above, according to this embodiment, the load current of the driving motor 121 is electrically detected under the loaded and unloaded driving conditions, and the linear stroke of the counter weight 171 is controlled based on the detection. Therefore, compared with the known method of detecting loaded and unloaded driving conditions by using a mechanical detecting mechanism and changing the linear stroke of the counter weight 171 based on the detection, the vibration reducing control system can be simplified.

Further, in this embodiment, under the loaded and unloaded driving conditions, respective vibration reductions for the loaded driving conditions and the unloaded driving conditions are performed by changing the linear stroke of the counter weight 171. In place of the construction in which the linear stroke of the counter weight 171 is changed, the number of linear strokes of the counterweight 171 may be changed. Specifically, under the loaded driving conditions, the driving motor 121 may be driven at a predetermined number of revolutions, so that the counter weight 171 is driven with a predetermined number of linear strokes corresponding to vibration under the loaded driving conditions. While, under the unloaded driving conditions, the driving motor 121 may be driven at a lower speed than under the loaded driving condition, so that the counter weight 171 is driven with a lower number of linear strokes than under the loaded driving conditions. Alternative to this construction, only the number of linear strokes of the counter weight 171 may be reduced, for example, via a speed reducing means, without changing the number of revolutions of the driving motor 121, so that the counter weight 171 is driven with a lower number of linear strokes than under the loaded driving conditions.

Second Representative Embodiment of the Invention

Figure 10:
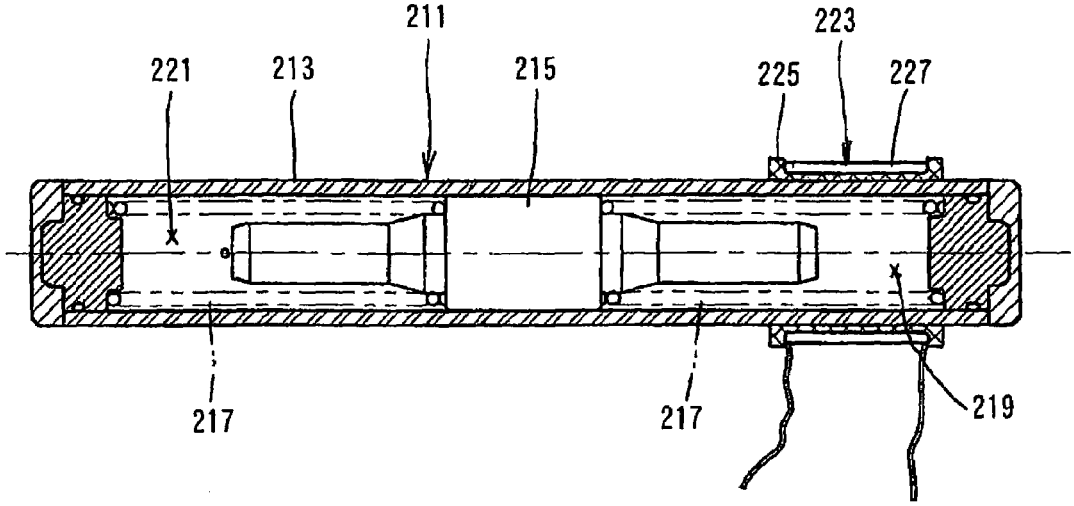
FIG. 10 is a view showing a dynamic vibration reducer having a vibration means according to a second embodiment.

A second representative embodiment of the present invention will now be described with reference to FIG. 10. In the second embodiment, a dynamic vibration reducer 211 is used in place of the counter weight 171 as a vibration reducing mechanism. As to other elements, the second representative embodiment has the same construction as the above-described first embodiment except for a mechanism for driving the counter weight 171 and a mechanism for changing the linear stroke of the counter weight 171.

The dynamic vibration reducer 211 mainly includes a cylindrical body 213 that is disposed adjacent to the hammer body 103, a weight 215 that is made of iron (magnetic material) and disposed within the cylindrical body 213, and biasing springs 217 that are disposed on the right and left sides of the weight 215. The biasing springs 217 are features that correspond to the "elastic element" according to this invention. The biasing springs 217 exert a spring force on the weight 215 in a direction toward each other when the weight 215 moves in the axial direction of the cylindrical body 213 (in the axial direction of the hammer bit 113). A first actuation chamber 219 and a second actuation chamber 221 are defined on the both sides of the weight 215 within the cylindrical body 213.

The dynamic vibration reducer 211 according to this invention includes a solenoid 223 as a forcible vibration means for forcibly causing vibration in the dynamic vibration reducer 211 by actively driving the weight 215. In this specification, forcibly causing vibration in the dynamic vibration reducer 211 is referred to as forced vibration. The solenoid 223 mainly includes a frame 225 that is disposed on the axial end of the outer periphery of the cylindrical body 213, a solenoid coil 227 in the frame 225, and a weight 215 that corresponds to a movable core. The solenoid 223 applies a voltage to the solenoid coil 227 and thus supplies solenoid current. The solenoid 223 attracts the weight 215 against the biasing force of the biasing spring 217 and thus actively drives the weight 215. As a result, the dynamic vibration reducer 211 generates vibration. In this case, the frequency of vibration generated by the dynamic vibration reducer 211 is appropriately adjusted by changing the frequencies of energization and de-energization of the solenoid coil 227, or by changing the operating cycle of the solenoid 223. Further, the amplitude of vibration generated by the dynamic vibration reducer 211 is appropriately adjusted by changing the value of current to be passed to the solenoid coil 227. Moreover, the phase of vibration generated by the dynamic vibration reducer 211 is appropriately adjusted by changing the timing of operation for passing the current to the solenoid 227.

During the hammering operation, when the load current of the driving motor 121 is larger than the threshold value, it is determined that it is under the loaded driving conditions in which the hammer bit 113 is subjected to a load caused by the hammering operation. At this time, the solenoid coil 227 is controlled such that the dynamic vibration reducer 211 generates vibration corresponding to the vibration caused in the axial direction of the hammer bit under the loaded driving conditions. On the other hand, when the load current of the driving motor 121 is smaller than the threshold value, it is determined that it is under the unloaded driving conditions in which the hammer bit 113 is not subjected to a load caused by the hammering operation. At this time, the solenoid coil 227 is controlled such that the dynamic vibration reducer 211 generates smaller vibration than under the loaded driving conditions. Otherwise, the solenoid coil 227 is kept in the de-energized state, so that the weight 215 is not actively driven.

With the above-described construction, under loaded driving conditions in which vibration reduction is highly desired, the solenoid 223 forcibly vibrates the dynamic vibration reducer 211 such that the dynamic vibration reducer 211 generates vibration corresponding to the magnitude of vibration caused in the hammer body 103. In this manner, the dynamic vibration reducer 211 can reduce vibration under loaded driving conditions. On the other hand, under unloaded driving conditions in which vibration reduction is less desired, the solenoid 223 forcibly vibrates the dynamic vibration reducer 211 such that the dynamic vibration reducer 211 generates vibration corresponding to the magnitude of vibration caused in the hammer body 103. Or the counter weight 215 serves as a passive dynamic vibration reducer 211 which is driven with an external force of vibration of the hammer body 103. In this manner, the dynamic vibration reducer 211 can reduce vibration under unloaded driving conditions. The mode in which the dynamic vibration reducer 211 optimizes vibration reduction under loaded driving conditions corresponds to the "first mode", and the mode in which the dynamic vibration reducer 211 optimizes vibration reduction under unloaded driving conditions corresponds to the "second mode", according to this invention.

According to this invention, the solenoid 223 is controlled based on the detection of the load current of the driving motor 121, so that the dynamic vibration reducer 211 can be operated in respective appropriate manners for the loaded driving conditions and the unloaded driving conditions. Therefore, like in the first embodiment, a simpler vibration reducing control system can be realized. Further, the degree of freedom of installation location of the dynamic vibration reducer 211 can be increased by using the solenoid 223 as a means for forcibly vibrating the dynamic vibration reducer 211.

Third Representative Embodiment of the Invention

Figure 11:
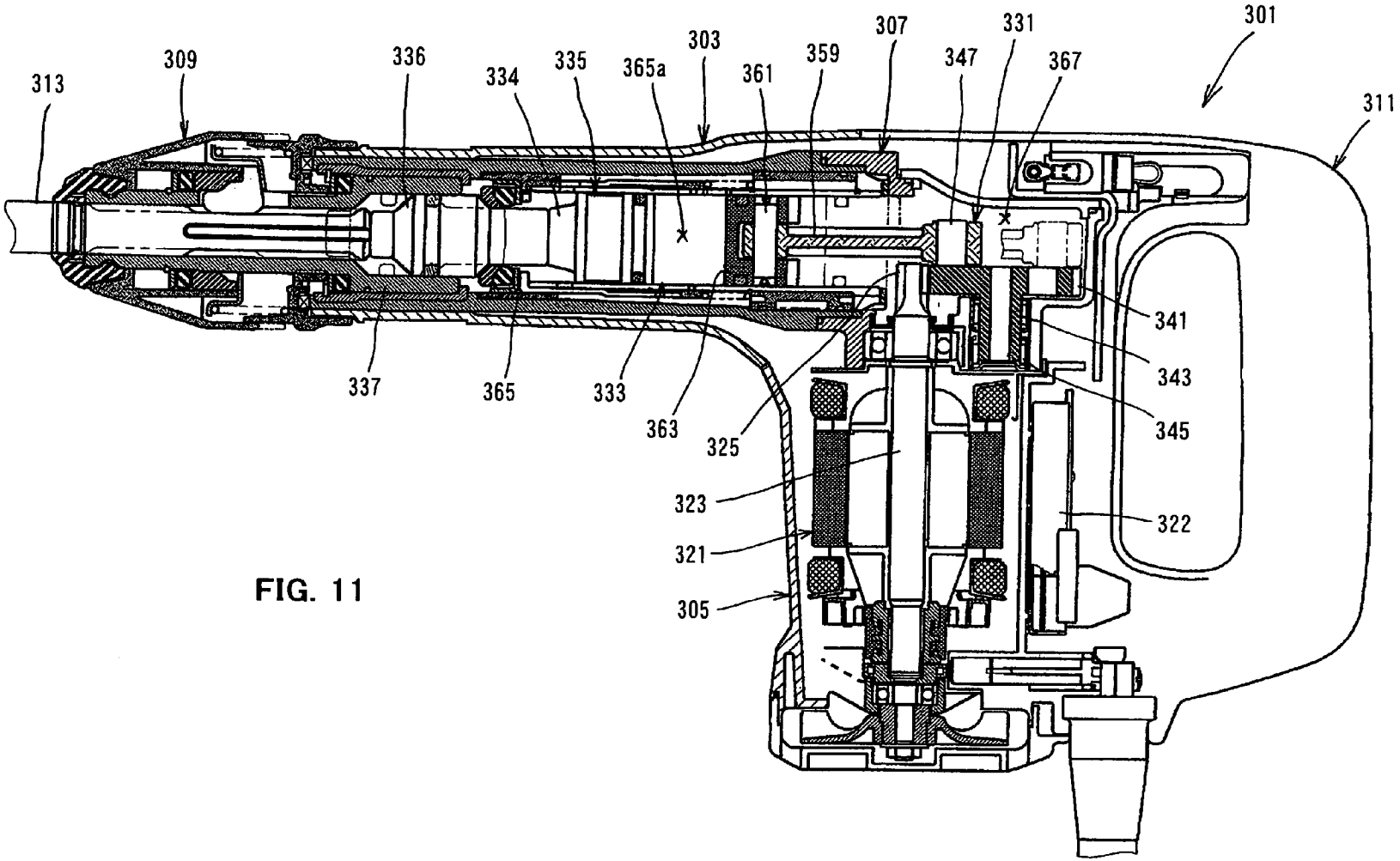
FIG. 11 is a sectional side view schematically showing an entire electric hammer according to a third embodiment of the invention.
Figure 12:
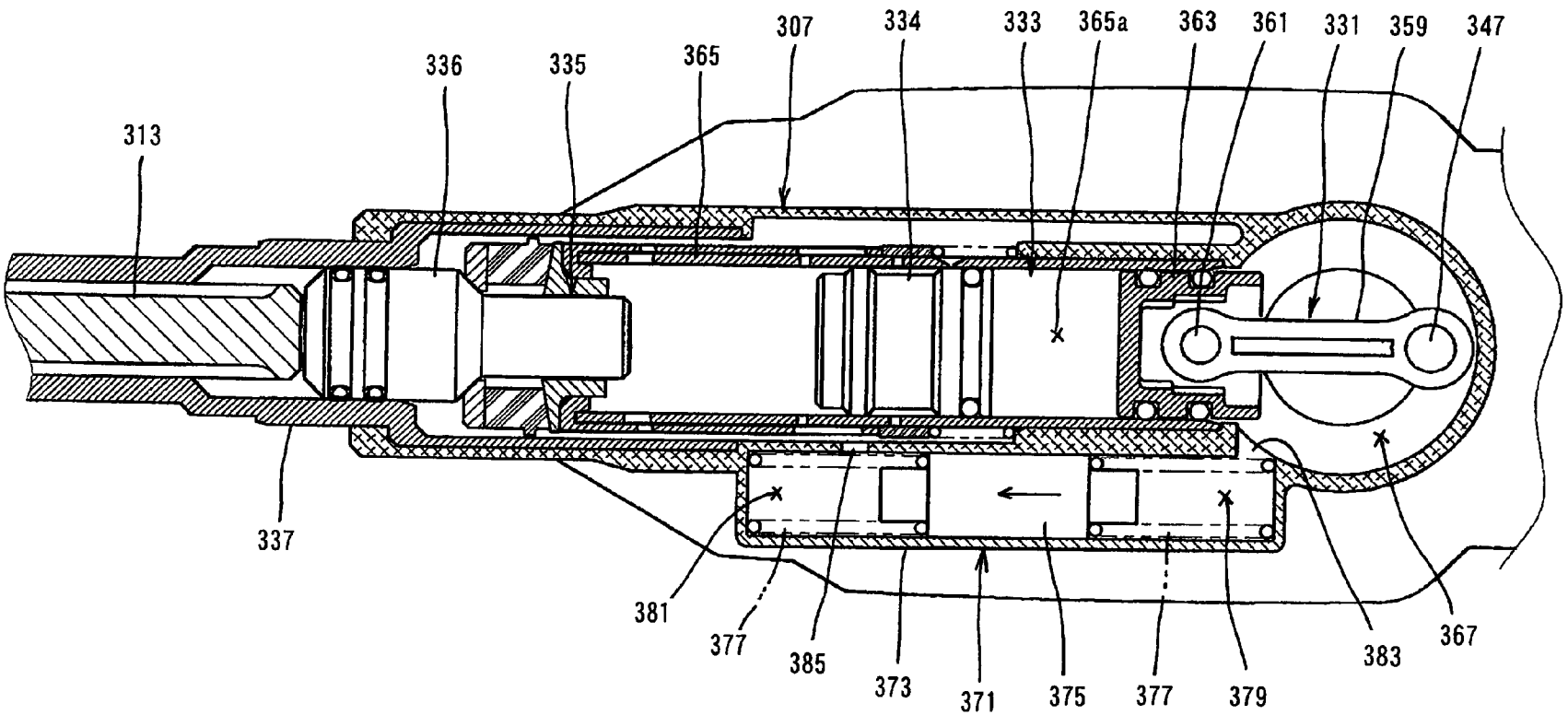
FIG. 12 is a sectional plan view showing an essential part of the electric hammer according to the third embodiment, with a piston located in right dead center.
Figure 13:
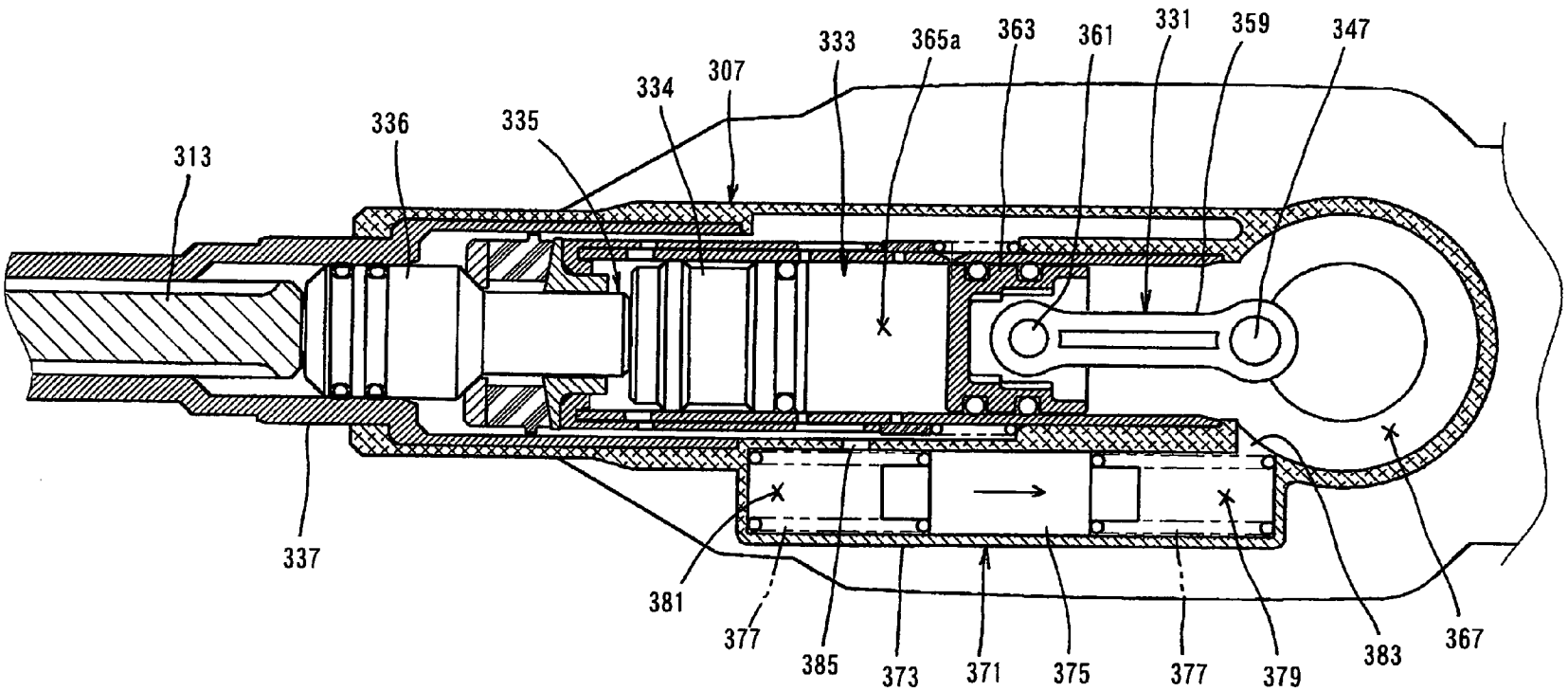
FIG. 13 is a sectional plan view showing the essential part of the electric hammer according to the third embodiment, with the piston located in left dead center.
Figure 14:
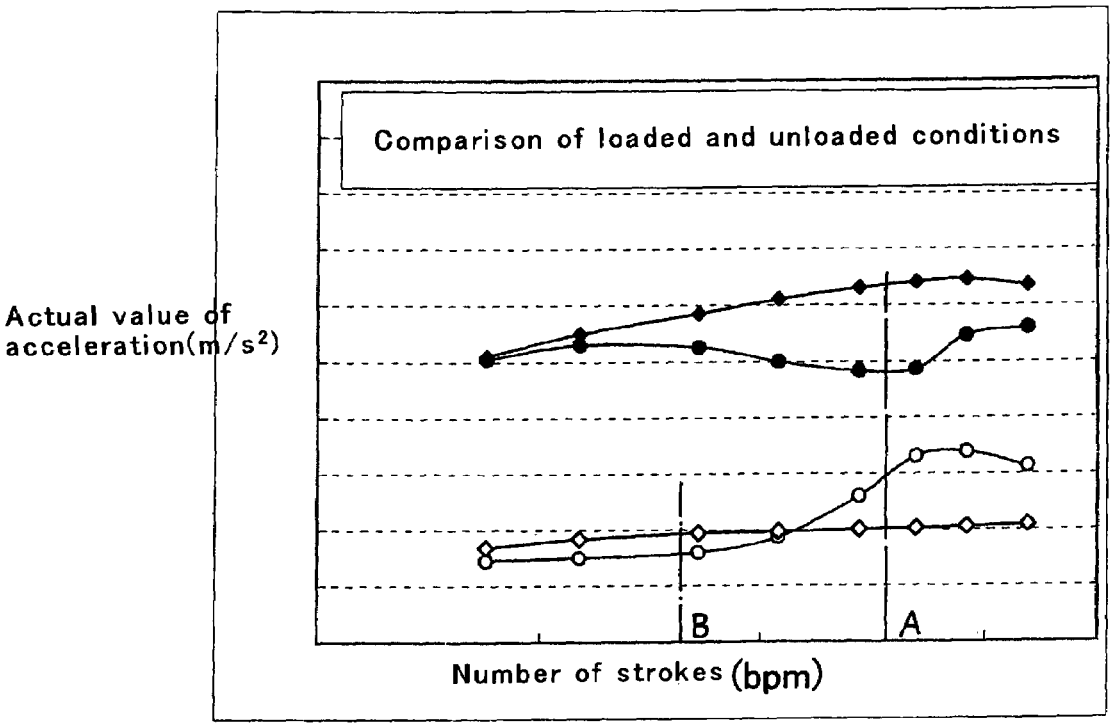
FIG. 14 is a view illustrating the vibration reducing effect of the dynamic vibration reducer during hammering operation.

A third representative embodiment of the present invention will now be described with reference to FIGS. 11 to 14. FIG. 11 is a sectional side view showing the entire construction of a hammer 301 according to this embodiment. FIGS. 12 and 13 are sectional plan views showing an essential part of the hammer 301. FIG. 14 is a view illustrating a vibration reducing effect of the dynamic vibration reducer when the hammer is driven.

The hammer 301 according to this embodiment includes a hammer body 303 having a motor housing 305, a gear housing 307 and a handgrip 311. A hammer bit 313 is coupled to the tip end (the left end region as viewed in the drawings) of the hammer body 303 via a hammer bit mounting chuck 309.

The motor housing 305 houses a driving motor 321. The gear housing 307 houses a crank mechanism 331, an air cylinder mechanism 333 and a striking force transmitting mechanism 335. A tool holder 337 for holding the hammer bit 313 is disposed on the end (left end as viewed in FIG. 11) of the striking force transmitting mechanism 335 within the gear housing 307. The crank mechanism 331 in the gear housing 307 appropriately converts the rotating output of an output shaft 323 of the driving motor 321 into linear motion and transmits the motion to the hammer bit 313. As a result, the hammer bit 313 is caused to perform a hammering operation. The tool holder 337 holds the hammer bit 313 in such a manner that the hammer bit 313 can reciprocate with respect to the tool holder 337 in its longitudinal direction and is prevented from rotating in its circumferential direction with respect to the tool holder 337. The crank mechanism 331 is a feature that corresponds to the "motion converting mechanism" according to this invention.

The crank mechanism 331 includes a speed change gear 341, a gear shaft 133, a gear shaft support bearing 345 and a crank pin 347. The speed change gear 341 engages with a gear part 325 of the output shaft 323 of the driving motor 321. The gear shaft 143 rotates together with the speed change gear 341. The gear shaft support bearing 345 rotatably supports the gear shaft 343. The crank pin 347 is integrally formed with the speed change gear 341 in a position displaced a predetermined distance from the center of rotation of the gear shaft 343. The crank pin 347 is connected to one end of a crank arm 359. The other end of the crank arm 359 is connected to a driver in the form a piston 363 via a connecting pin 361. The piston 163 is disposed within a bore of a cylinder 365 that forms the air cylinder mechanism 333. The speed change gear 341, the crank pin 347 and the crank arm 359 are disposed within a crank chamber 367. The crank chamber 367 is a feature that corresponds to the "motion converting mechanism chamber" according to this invention. The crank chamber 367 is prevented from communication with the outside by a sealing structure which is not shown. The effective capacity of the crank chamber 367 periodically increases or decreases according to the movement of the piston 363 which is moved within the cylinder 365 via the crank arm 359. The piston 363 slides within the cylinder 365 so as to linearly drive the striker 334 by the action of an air spring of an air spring chamber 365*a*. As a result, the piston 363 generates impact loads upon the hammer bit 313 via an intermediate element in the form of an impact bolt 336. The striker 334 and the impact bolt 336 form the striking force transmitting mechanism 335. The striker 334 is a feature that corresponds to the "striker" in the present invention.

As shown in FIGS. 12 and 13, the hammer 301 according to this embodiment has a dynamic vibration reducer 371. The dynamic vibration reducer 371 is a feature that corresponds to the "vibration reducing mechanism" according to this invention. The dynamic vibration reducer 371 mainly includes a cylindrical body 373 that is disposed adjacent to the hammer body 303, a weight 375 that is disposed within the cylindrical body 373, and biasing springs 377 that are disposed on the right and left sides of the weight 375. The biasing springs 377 are features that correspond to the "elastic element" according to this invention. The biasing springs 377 exert a spring force on the weight 375 in a direction toward each other when the weight 375 moves in the axial direction of the cylindrical body 373 (in the axial direction of the hammer bit). A first actuation chamber 379 and a second actuation chamber 381 are defined on the both sides of the weight 375 within the cylindrical body 373. The first actuation chamber 379 communicates with the crank chamber 367 via a first communication part 383 at all times.

When the hammer 301 is driven, the piston 363 linearly moves within the cylinder 365, so that the capacity of the crank chamber 363 which is sealed against the atmosphere changes. For example, when the piston 363 moves from the left dead center position shown in FIG. 13 to the right dead center position shown in FIG. 12, the capacity of the crank chamber 363 increases, so that the pressure within the crank chamber 363 decreases. Such pressure fluctuations are transmitted to the first actuation chamber 379 of the dynamic vibration reducer 371 via the first communication part 383. Therefore, when the capacity of the crank chamber 367 decreases and thus the pressure of the crank chamber 367 increases, the weight 375 is acted upon by a force in the direction of the arrow shown in FIG. 12. On the other hand, when the capacity of the crank chamber 367 increases and thus the pressure of the crank chamber 367 decreases, the weight 375 is acted upon by a force in the direction of the arrow shown in FIG. 13. Specifically, when the hammer 301 is driven, the dynamic vibration reducer 371 actively drives the weight 375 by pressure fluctuations transmitted from the crank chamber 367 and thereby forcibly vibrates the dynamic vibration reducer 371. In the following description, forcibly vibrating the dynamic vibration reducer 371 is referred to as forced vibration. The pressure transmitted to the first actuation chamber 379 forcibly vibrates the dynamic vibration reducer 371 and forms the forcible vibration means for the dynamic vibration reducer 371. Specifically, the pressure provides the dynamic vibration reducer 371 with a driving force of forcibly vibrating the dynamic vibration reducer 371.

As described in the first embodiment, the load current of the driving motor 321 that drives the hammer bit 313 increases under loaded driving conditions in which the hammer bit 313 is subjected to a load caused by a hammering operation (external force or reaction force that is inputted from the workpiece side to the hammer bit 313 during hammering operation), while it decreases under unloaded driving conditions in which the hammer bit 313 is not subjected to a load caused by a hammering operation. In consideration of this technical aspect, a motor controller 322 (motor control circuit, see FIG. 11) for controlling the drive of the driving motor 121 detects change of the load current of the driving motor 321. Based on this detection result, the number of revolutions of the driving motor 321 is controlled. Specifically, in the driving state of the hammer 301, when the load current of the driving motor 321 exceeds a threshold value, it is determined that it has been shifted from the unloaded driving conditions to the loaded driving conditions. At this time, the driving motor 321 is controlled to be driven at a predetermined high number of revolutions. On the other hand, when the load current of the driving motor 121 decreases below the threshold value, it is determined that it has been shifted from the loaded driving conditions to the unloaded driving conditions. At this time, the driving motor 321 is controlled to be driven at a lower number of revolutions than under the loaded driving conditions.

Operation and usage of the hammer 301 having the above-described construction will now be explained. When the driving motor 321 is driven, the piston 363 is caused to reciprocate within the bore of the cylinder 365 via the output shaft 323, the speed change gear 341, the crank pin 347, the crank arm 359 and the connecting pin 361. At this time, under the loaded driving conditions in which the hammer bit 313 is pressed against the workpiece, the hammer bit 313 is driven linearly in its axial direction via the air cylinder mechanism 331 and the striking force transmitting mechanism 335. Specifically, when the piston 363 slides toward the hammer bit 313, which causes an air spring action of the air spring chamber 365*a* that is defined between the piston 363 and the striker 334, the striker 334 is caused to reciprocate in the same direction within the cylinder 365 by the air spring action and collides with the impact bolt 336. The kinetic energy (striking force) of the striker 334 which is caused by the collision is transmitted to the hammer bit 313. Thus, the hammer bit 313 slidingly reciprocates within the tool holder 337 and performs a hammering operation on the workpiece.

The dynamic vibration reducer 371 disposed in the hammer body 303 serves to reduce impulsive and cyclic vibration caused when the hammer bit 313 is driven as mentioned above. Specifically, the weight 375 and the biasing springs 377 which serve as vibration reducing elements in the dynamic vibration reducer 371 cooperate to passively reduce vibration of the hammer body 303 on which a predetermined external force (vibration) is exerted. At the same time, the dynamic vibration reducer 371 also acts as an active vibration reducing mechanism by forced vibration or by actively driving the weight 375 by utilizing the pressure fluctuations of the crank chamber 367. Thus, vibration caused in the hammer body 303 can be effectively alleviated or reduced during hammering operation.

Specifically, when the hammer 301 is driven and the piston 363 linearly moves within the cylinder 365, the capacity of the crank chamber 367 changes and thus the pressure within the crank chamber 367 increases or decreases. Such pressure fluctuations of the crank chamber 367 are transmitted to the first actuation chamber 379 of the dynamic vibration reducer 371 via the first communication part 383. Therefore, when the pressure of the first actuation chamber 379 increases, the weight 375 is acted upon by a force in the direction of the arrow shown in FIG. 12. On the other hand, when the pressure of the first actuation chamber 379 decreases, the weight 375 is acted upon by a force in the direction of the arrow shown in FIG. 13. Specifically, when the hammer 301 is driven, the weight 375 of the dynamic vibration reducer 371 is actively driven by pressure fluctuations transmitted from the crank chamber 367.

At this time, when the weight 375 linearly moves within the cylindrical body 373, the outside air is introduced into or discharged from the second actuation chamber 381 through a second communication part 385 formed in the second actuation chamber 381. With this construction, when the weight 375 moves, expansion (adiabatic expansion) or compression (adiabatic compression) of the inner space of the second actuation chamber 381 can be effectively prevented which will be caused if air communication with the outside is interrupted.

Under the loaded driving conditions in which the hammer bit 313 is subjected to a load caused by a hammering operation, as described above, the driving motor 321 is driven at a predetermined high number of revolutions. The dynamic vibration reducer 371 is configured to effectively reduce vibration caused in the hammer body 303 in the axial direction of the hammer bit under the loaded driving conditions. For example, it is configured such that the vibration generated by the dynamic vibration reducer 371 by forced vibration corresponds in magnitude to vibration caused in the axial direction of the hammer bit under the loaded driving conditions and such that the vibrations are caused in opposite phase. Further, the natural frequency of the dynamic vibration reducer 371 is set to be in the region of the maximum stroke of the striker 334 which strikes the hammer bit 313 under the loaded driving conditions. Thus, the dynamic vibration reducer 371 can effectively reduce vibration under the loaded driving conditions.

In the hammer 301 having the above-described construction, in this embodiment, under the unloaded driving conditions in which the hammer bit 313 is not subjected to a load caused by a hammering operation, the number of revolutions of the driving motor 321 is reduced below that under the loaded driving conditions, so that the vibration generated by the dynamic vibration reducer 371 is also reduced. Under the unloaded driving conditions, the striker 334 and the hammer bit 313 are not driven by the idle hammering preventing mechanism (which is a known technique and will not be described) of the hammer 301. Therefore, under the unloaded driving conditions, vibration in the axial direction of the hammer bit is mainly caused by reciprocating movement of the piston 363. Such vibration is smaller than under the loaded driving conditions and the phase changes. In this embodiment, the number of revolutions of the driving motor 321 is reduced under the unloaded driving conditions. With this arrangement, vibration generated by the dynamic vibration reducer 371 is reduced, and the frequency of this vibration is displaced from the natural frequency of the dynamic vibration reducer 371. Further, the phase is changed. In this manner, the vibration reducing effect under the unloaded driving conditions can be enhanced.

The vibration reducing effect of the dynamic vibration reducer 371 during hammer driving is now explained with reference to FIG. 14. FIG. 14 shows the results of an experiment on vibration in the axial direction of the hammer bit. This experiment was conducted, with the dynamic vibration reducer 371 installed in the hammer 301, both in the operating and non-operating conditions of the dynamic vibration reducer 371, both under the loaded and unloaded driving conditions. In order to keep the total weight of the hammer 301 constant so as to keep the experimental conditions unchanged, the experiment was conducted, with the dynamic vibration reducer 371 installed in the hammer 301, both in the operating and non-operating conditions of the dynamic vibration reducer 371. In FIG. 14, vibrations of the hammer body 303 during operation of the dynamic vibration reducer 371 (vibration after vibration reduction) are plotted by circles. Specifically, in this case, vibrations under the loaded and unloaded driving conditions are plotted by solid circles and outline circles, respectively. Further, vibrations of the hammer body 303 during non-operation of the dynamic vibration reducer 371 are plotted by rhombuses. Specifically, in this case, vibrations under the loaded and unloaded driving conditions are plotted by solid rhombuses and outline rhombuses, respectively.

According to the experimental results, when the dynamic vibration reducer 371 is in the non-operating condition, under the loaded driving conditions, vibration caused in the hammer body 303 in the axial direction of the hammer bit by driving of the hammer 301 gradually increases with increase of the number of strokes. Under the unloaded driving conditions, such vibration increases with increase of the number of strokes at a lower increase rate than under the loaded driving conditions. On the other hand, when the dynamic vibration reducer 371 is in the operating condition, under the loaded driving conditions, vibration caused in the hammer body 303 in the axial direction of the hammer bit by driving of the hammer 301 gradually decreases with increase of the number of strokes and thereafter increases from a certain point. Under the unloaded driving conditions, such vibration decreases with increase of the number of strokes and thereafter increases from a certain point. As clearly seen from the results of the experiment in the operating conditions of the dynamic vibration reducer 371, optimum vibration reducing effect under the loaded driving conditions is exerted when the number of strokes is around a region shown by A in the drawing, while optimum vibration reducing effect under the unloaded driving conditions is exerted when the number of strokes is around a region shown by B in the drawing. Therefore, under the loaded driving conditions, optimum vibration reduction by the dynamic vibration reducer 371 can be realized by driving the driving motor 213 at such a number of revolutions that the number of strokes is around the region A. Under the unloaded driving conditions, optimum vibration reduction by the dynamic vibration reducer 371 can be realized by driving the driving motor 213 at such a number of revolutions that the number of strokes is around the region B.

According to this embodiment, the loaded or unloaded driving conditions during hammering operation are detected by change of the load current of the driving motor 321. Then the pressure for driving the weight 375, or the amount of drive to be provided to the dynamic vibration reducer 371 is changed between loaded driving mode in which the dynamic vibration reducer 371 optimizes the vibration reducing effect by generating vibration corresponding to vibration caused under the loaded driving conditions, and unloaded driving mode in which the dynamic vibration reducer 371 optimizes the vibration reducing effect by generating vibration corresponding to vibration caused under the unloaded driving conditions. With this construction, optimum vibration reducing effect of the dynamic vibration reducer 371 can be obtained both under the loaded and unloaded driving conditions. The loaded driving mode and the unloaded driving mode are features that correspond to the "first mode" and the "second mode", respectively, according to this invention.

DESCRIPTION OF NUMERALS

101 electric hammer
103 hammer body
105 motor housing
107 gear housing
108 housing cap
109 hammer bit mounting chuck
111 handgrip
113 hammer bit
121 driving motor
123 output shaft
125 output shaft gear part
131 crank mechanism
133 air cylinder mechanism
134 striker
135 striking force transmitting mechanism
136 impact bolt
137 tool holder
141 speed change gear
143 gear shaft
145 gear shaft support bearing
147 crank pin
147*a* top pin part
159 crank arm
161 connecting pin
163 piston (driver)
165 cylinder
165*a* air spring chamber
171 counter weight (vibration reducing mechanism)
171*a* slot
171*b* guide slot
172 guide pin
173 counter weight driving mechanism (power transmitting mechanism)
175 externally-toothed internal gear
175*a* internal teeth
175*b* external teeth
177 idle gear
177*a* shaft
179 planetary gear
179*a* shaft
181 carrier
181*a* engagement recess
182 carrier support bearing
183 counter weight driving pin (power transmitting part)
185 stroke changing mechanism (power transmitting mechanism)
187 intermediate gear
189 stroke changing mechanism
191 wormwheel
193 worm gear
195 auxiliary motor
197 first sensor
198 second sensor
199 magnet
211 dynamic vibration reducer (vibration reducing mechanism)
213 cylindrical body (body)
215 weight
217 biasing spring (elastic element)
219 first actuation chamber
221 second actuation chamber
223 solenoid
225 frame
227 solenoid coil
301 electric hammer
303 hammer body
305 motor housing
307 gear housing
308 housing cap
309 hammer bit mounting chuck
311 handgrip
313 hammer bit
321 driving motor
323 output shaft
325 output shaft gear part
331 crank mechanism (motion converting mechanism)
333 air cylinder mechanism
334 striker
335 striking force transmitting mechanism
336 impact bolt
337 tool holder
341 speed change gear
343 gear shaft
345 gear shaft support bearing
347 crank pin
347*a* top pin part
359 crank arm
361 connecting pin
363 piston (driver)
365 cylinder
365*a* air spring chamber
367 crank chamber (motion converting mechanism chamber)
371 dynamic vibration reducer (vibration reducing mechanism)
373 cylindrical body (body)
375 weight
377 biasing spring (elastic element)
379 first actuation chamber
381 second actuation chamber
383 first communication part
385 second communication part

The invention claimed is:

1. An electric hammer comprising:

an electric hammer body, a hammer bit that is coupled to the body and performs a hammering operation in contact with a workpiece, a driving motor that is housed within the body, a striker that is housed within the body and driven by the driving motor to apply a striking force to the hammer bit, a vibration reducing mechanism that is linearly driven in an axial direction of the hammer bit and generates vibration, thereby reducing vibration caused in the body, and a controller that is configured to change an amount of drive to be provided for the vibration reducing mechanism between a first mode and a second mode, wherein:

in the first mode, under loaded driving conditions in which a load acts on the hammer bit from the workpiece side by the hammering operation, the vibration reducing mechanism optimizes vibration reduction by generating vibration corresponding to vibration caused in the body, and in the second mode, under unloaded driving conditions in which the driving motor is energized while the hammering operation is not performed so that no load acts on the hammer bit from the workpiece side, the vibration reducing mechanism optimizes vibration reduction by generating vibration corresponding to vibration caused in the body.

2. The electric hammer as defined in claim 1, wherein:

the vibration reducing mechanism comprises a dynamic vibration reducer including a body, a weight that is housed within the body and can linearly move in the axial direction of the hammer bit, and an elastic element that connects the weight to the body, the dynamic vibration reducer is constructed such that the weight is linearly moved by a driving mechanism that converts the rotating output of the driving motor into linear motion, in the first mode, the dynamic vibration reducer is provided with a predetermined amount of drive by rotation of the driving motor at a predetermined number of revolutions, while, in the second mode, the dynamic vibration reducer is provided with a different amount of drive from that in the first mode by rotation of the driving motor at a lower number of revolutions than in the first mode.

3. The electric hammer as defined in claim 1, wherein the body comprises:

a motion converting mechanism that converts the rotating output of the driving motor into linear motion and transmits the linear motion to the striker and a motion converting mechanism chamber that houses the motion converting mechanism and the pressure of which periodically fluctuates with increase and decrease of its capacity when the motion converting mechanism is driven, the vibration reducing mechanism comprises a dynamic vibration reducer including a body, a weight that is housed within the body and can linearly move in the axial direction of the hammer bit, and an elastic element that connects the weight to the body, the dynamic vibration reducer is constructed such that the weight is linearly moved by a pressure that is introduced from the motion converting mechanism chamber into the body, in the first mode, the dynamic vibration reducer is provided with a predetermined amount of drive by rotation of the driving motor at a predetermined number of revolutions, while, in the second mode, the dynamic vibration reducer is provided with a different amount of drive from that in the first mode by rotation of the driving motor at a lower number of revolutions than in the first mode.

4. The electric hammer as defined in claim 1, wherein:

the vibration reducing mechanism comprises a dynamic vibration reducer including a body, a weight that is housed within the body and can linearly move in the axial direction of the hammer bit, and an elastic element that connects the weight to the body, the dynamic vibration reducer is constructed such that the weight is linearly driven by a solenoid, in the first mode, the solenoid provides the dynamic vibration reducer with a predetermined amount of drive, while, in the second mode, the solenoid provides the dynamic vibration reducer with a different amount of drive from that in the first mode.

5. The electric hammer as defined in claim 1, wherein:

the vibration reducing mechanism includes a counter weight that is driven by the driving motor and linearly moves in the axial direction of the hammer bit, in the first mode, the counter weight is driven by rotation of the driving motor at a predetermined number of revolutions, while, in the second mode, the counter weight is driven by rotation of the driving motor at a lower number of revolutions than in the first mode.

6. The electric hammer as defined in claim 1, wherein, in the first and second modes, vibration reduction is optimized by changing at least one of the amplitude, frequency and phase of the vibration reducing mechanism.

7. The electric hammer as defined in claim 1, wherein:

the vibration reducing mechanism comprises a dynamic vibration reducer including a body, a weight that is housed within the body and can linearly move in the axial direction of the hammer bit, and an elastic element that connects the weight to the body, and the natural frequency of the dynamic vibration reducer is set to correspond to the maximum stroke of the striker which strikes the hammer bit.

8. The electric hammer as defined in claim 1, wherein, during hammering operation, the controller detects the load conditions of the hammer bit based on an external force acting on the hammer bit from the workpiece side by the magnitude of the load current of the driving motor, and the vibration reducing mechanism is controlled according to the detected load conditions.

9. The electric hammer as defined in claim 8, wherein:

the loaded and unloaded driving conditions of the hammer bit are detected by the magnitude of the load current of the driving motor, upon detection of the loaded driving conditions, the vibration reducing mechanism generates vibration corresponding to vibration caused in the body under the loaded driving conditions, upon detection of the unloaded driving conditions, the vibration reducing mechanism generates vibration corresponding to vibration caused in the body under the unloaded driving conditions, or the vibration reducing mechanism stops generating vibration, whereby vibration reduction is optimized under the loaded and unloaded driving conditions.

10. The electric hammer as defined in claim 8, wherein the vibration reducing mechanism is constructed to be driven and controlled according to the magnitude of the load current, and the vibration reducing mechanism is driven and controlled via a motor control device that drives and controls the driving motor.

11. The electric hammer as defined in claim 8, wherein:

the vibration reducing mechanism comprises a counter weight that linearly moves in the axial direction of the hammer bit and thereby reduces vibration during hammering operation, the counter weight is driven by a power transmitting mechanism that converts the rotating output of the driving motor into linear motion in the axial direction of the hammer bit, the loaded and unloaded driving conditions of the hammer bit are detected by the magnitude of the load current of the driving motor, and the amount of linear motion of the counter weight driven by the power transmitting mechanism in the axial direction of the hammer bit differs according to whether under the loaded driving conditions or under the unloaded driving conditions.

12. The electric hammer as defined in claim 11, wherein the power transmitting mechanism includes:

an internal gear that is rotatably supported and normally held in a rest state, a planetary gear that is driven by the rotating output of the driving motor and revolves around the center of the internal gear, a power transmitting part that is eccentrically disposed in the planetary gear and connected to the counter weight, an auxiliary motor that is driven according to the detection of the loaded or unloaded driving conditions and rotates the internal gear held in the rest state, and a positioning means that detects a predetermined amount of rotation of the internal gear and stops the auxiliary motor so as to position the power transmitting part in a predetermined position, wherein:

based on the detection of the loaded or unloaded driving conditions, the auxiliary motor is driven and the internal gear is rotated, and thereafter, the auxiliary motor is stopped according to the detection of the predetermined amount of rotation of the internal gear, so that the position of the power transmitting part is changed with respect to a point of proximity of the planetary gear to the internal gear, whereby the linear stroke of the counter weight in the axial direction of the hammer bit is changed via the power transmitting part.

13. The electric hammer as defined in claim 8, wherein:

the vibration reducing mechanism comprises a dynamic vibration reducer including a body, a weight that is housed within the body and can linearly move in the axial direction of the hammer bit, and an elastic element that connects the weight to the body, the dynamic vibration reducer is constructed such that the weight is linearly driven by a solenoid, the loaded and unloaded driving conditions of the hammer bit are detected by the magnitude of the load current of the driving motor, operation of the solenoid is controlled such that, upon detection of the loaded driving conditions, the dynamic vibration reducer generates vibration corresponding to vibration caused under the loaded driving conditions, while, upon detection of the unloaded driving conditions, the dynamic vibration reducer generates vibration corresponding to vibration caused under the unloaded driving conditions, whereby vibration reduction by the dynamic vibration reducer is optimized under the loaded and unloaded driving conditions.

14. The electric hammer as defined in claim 8, wherein the body includes:

a motion converting mechanism that converts the rotating output of the driving motor into linear motion and transmits the linear motion to the striker, and a motion converting mechanism chamber that houses the motion converting mechanism and the pressure of which periodically fluctuates with increase and decrease of its capacity when the motion converting mechanism is driven, the vibration reducing mechanism comprises a dynamic vibration reducer including a body, a weight that is housed within the body and can linearly move in the axial direction of the hammer bit, and an elastic element that connects the weight to the body, the dynamic vibration reducer is constructed such that the weight is linearly moved by a pressure that is introduced from the motion converting mechanism chamber into the body, the loaded and unloaded driving conditions of the hammer bit are detected by the magnitude of the load current of the driving motor, pressure of the motion converting mechanism chamber is controlled such that, upon detection of the loaded driving conditions, the dynamic vibration reducer generates vibration corresponding to vibration caused under the loaded driving conditions, while, upon detection of the unloaded driving conditions, the dynamic vibration reducer generates vibration corresponding to vibration caused under the unloaded driving conditions, whereby vibration reduction by the dynamic vibration reducer is optimized under the loaded and unloaded driving conditions.

* * * * *